US009209520B2

(12) United States Patent
Oon et al.

(10) Patent No.: US 9,209,520 B2
(45) Date of Patent: Dec. 8, 2015

(54) HYBRID ANTENNA FOR PORTABLE COMMUNICATION DEVICES

(71) Applicant: Motorola Solutions, Inc., Schaumburg, IL (US)

(72) Inventors: Chin Keong Alexander Oon, Penang (MY); Sin Keng Lee, Kedah (MY)

(73) Assignee: Motorola Solutions, Inc., Schaumbhurg, IL (US)

( * ) Notice: Subject to any disclaimer, the term of this patent is extended or adjusted under 35 U.S.C. 154(b) by 311 days.

(21) Appl. No.: 13/767,520

(22) Filed: Feb. 14, 2013

(65) Prior Publication Data

US 2013/0207856 A1 Aug. 15, 2013

(51) Int. Cl.

| | |
|---|---|
| ***H01Q 1/24*** | (2006.01) |
| ***H01Q 9/06*** | (2006.01) |
| ***H01Q 1/08*** | (2006.01) |
| ***H01Q 1/36*** | (2006.01) |
| ***H01Q 9/42*** | (2006.01) |
| ***H01Q 21/28*** | (2006.01) |

(52) U.S. Cl.

CPC ..... *H01Q 9/06* (2013.01); *H01Q 1/088* (2013.01); *H01Q 1/242* (2013.01); *H01Q 1/362* (2013.01); *H01Q 9/42* (2013.01); *H01Q 21/28* (2013.01)

(58) Field of Classification Search

CPC ..... H01Q 9/06; H01Q 1/088; H01Q 21/28; H01Q 1/362; H01Q 9/42; H01Q 1/242

USPC ..... 343/702, 729, 745, 749, 895, 806

See application file for complete search history.

(56) References Cited

U.S. PATENT DOCUMENTS

| | | | | |
|---|---|---|---|---|
| 6,075,500 | A | 6/2000 | Kurz et al. | |
| 6,768,464 | B1 | 7/2004 | Shoji et al. | |
| 6,788,259 | B2 | 9/2004 | Amano et al. | |
| 6,956,530 | B2 | 10/2005 | Kadambi et al. | |
| 6,985,110 | B2 | 1/2006 | Tanaka et al. | |
| 7,084,831 | B2 * | 8/2006 | Takagi et al. | 343/860 |
| 7,154,442 | B2 | 12/2006 | Van Wonterghem et al. | |
| 7,408,515 | B2 | 8/2008 | Leisten | |
| 2002/0123312 | A1 | 9/2002 | Hayes et al. | |
| 2010/0085267 | A1 | 4/2010 | Yun et al. | |
| 2012/0127047 | A1 | 5/2012 | Gertenbach et al. | |

FOREIGN PATENT DOCUMENTS

| | | | |
|---|---|---|---|
| JP | 6152221 | A | 5/1994 |

OTHER PUBLICATIONS

Corresponding Chinese Patent Application No. 201301022316.3—Office Action dated Oct. 24, 2014.

Corresponding Malaysian Patent Application No. PI2012000651—Office Action dated Jun. 15, 2015.

* cited by examiner

*Primary Examiner* — Michael C Wimer

(74) *Attorney, Agent, or Firm* — Barbara R. Doutre

(57) ABSTRACT

An antenna structure (111) commences at a feed point (202) that is coupled to an inverted F antenna section (204). The inverted F antenna section is coupled to a monopole section (210) that is further coupled to a helical section (216). The inverted F section, monopole section, and helical section are coupled in series together.

12 Claims, 6 Drawing Sheets

HYBRID ANTENNA FOR PORTABLE COMMUNICATION DEVICES

FIELD OF THE DISCLOSURE

The present disclosure relates generally to antennas for portable communication devices, and more particularly to hybrid antennas that combine different types of antenna elements together in an antenna structure.

BACKGROUND

The most common example of mobile communication devices are cellular telephones. These devices are in common usage in most metropolitan regions of the world. Their prevalence has resulted in certain expectations people have about the aesthetics of such devices, and manufacturers design new mobile communication devices with such expectations in mind In addition, these expectations and design conventions of cellular telephones influence the design of other mobile communication devices, such as hand-held two way radios used by, for example, public safety and law enforcement personnel.

One aspect of mobile communication device design that has become common is the lack of an external antenna. Early cellular telephone antennas were entirely external screw-in type elements that resembled antennas used (and still in use) on two-way radio devices. However, cellular communication has since migrated to higher frequency bands, which has allowed the physical size of antennas for cellular telephone devices to be reduced. Over the years manufacturers have found various antenna geometries and configurations that have allowed for antenna designs that are entirely hidden such that cellular telephone devices using them appear to have no external antenna element. Two-way radio devices, however, which typically operate in significantly lower frequency bands than cellular telephone devices, have not been able to follow the trend of reducing the antenna size due to the wavelength and the required physical size of a radiating element necessary for acceptable radio performance.

Accordingly, there is a need for an antenna structure for a communication device that allows for an apparent substantial reduction in the size of the antenna without sacrificing radio performance.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
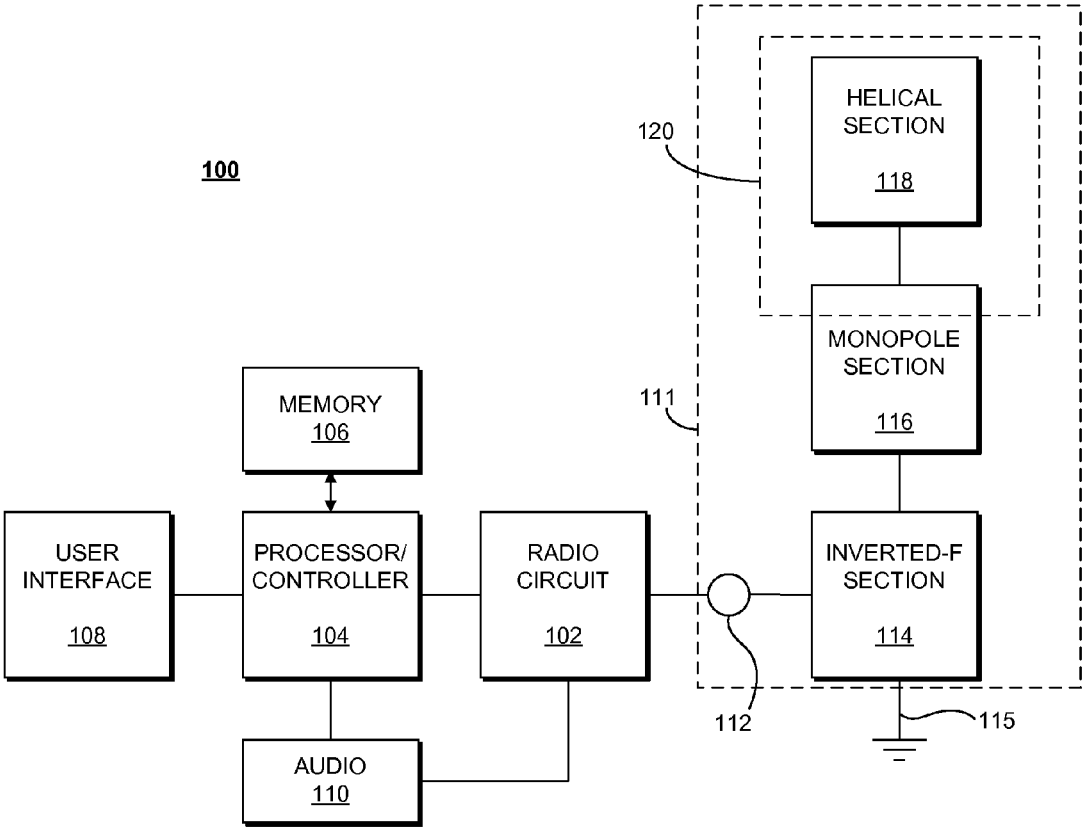
FIG. 1 is a block diagram of radio device in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Various embodiments disclosed herein solve the problems associated with the prior art by providing, for example, an antenna structure for a portable radio transceiver device. The antenna structure can include an inverted F section having a feed point, an inductive feed shunt coupled between the feed point and a ground, and a meander portion having a distal end opposite the feed point. The antenna structure of some embodiments further includes a monopole section having a first end and a terminal end, with the first end coupled to the distal end of the inverted F section. The antenna structure further includes a helical section coupled to the terminal end of the monopole section. The elements of the antenna structure result in an antenna that is relatively compact and usable in frequency bands commonly used by public safety and other two-way communication systems such that a large external antenna is not needed. In some embodiments the antenna structure can be adjusted by changing a small external antenna unit to tune the antenna structure to different frequency bands of operation.

FIG. 1 is a block diagram of radio device 100 in accordance with some embodiments. The radio device 100 includes a radio circuit 102 that can include a receiver, a transmitter, or both a receiver and transmitter (transceiver). In some embodiments the radio device 100 can be a portable radio device or portable radio transceiver device. Examples of radio devices include portable hand-held two way radios such as those used by police and other public safety operators, as well as industrial and commercial operators. Other radio devices, however, may likewise benefit from the disclosed antenna structure taught herein. The radio circuit 102 can be controlled or supervised by a processor or controller 104 which can be a microprocessor or microcontroller that executes instruction code. The instruction code can be stored or instantiated in a memory 106 that can be interfaced to the controller 104 via a bus, as is known. The memory 106 as used here can represent an aggregate memory including all memory types used in the device such as read only memory (ROM), random access memory (RAM), flash memory, and so on. The memory 106 can include components for instantiating an operating system, applications, virtual machines, variables, arrays and other data structures. The memory 106 can further contain instruction code for operating the radio device 100, including operating a user interface 108 and an audio section 110. The user interface 108 can include various user interface components, such as, for example, a graphical display, a keypad and other buttons (including software defined and virtual graphic buttons), vibration means, and acoustic transducers for generating various sounds. Generally the user interface components 108 are operated or supervised, directly or indirectly, by the processor 104, which may use one or more driver circuits and/or software components to facilitate operation of specific user interface components 108. The audio section 110 can receive digital audio signals from the radio circuit 102 and convert the digital audio signals into analog audio signals, and play the analog audio signals over an acoustic transducer such as a speaker. Similarly, in the reverse direction, for transmitting audio signals, the audio section 110 can include a microphone for receiving acoustic signals and producing an analog audio signal that the audio section 110 converts to a digital audio signal that is fed to the radio circuit 102 for transmission.

The radio circuit 102 is further coupled to an antenna structure 111. The antenna structure 111 includes a feed point 112 that is coupled to an inverted F antenna section 114. The feed point 112 is an impedance-matched interface between the radio section 102 and the antenna structure 111 and establishes a physical point around which the geometry of the antenna structure 111 can be arranged. Impedance matching can be accomplished using any known technique, such as lumped or simply lumped components, transmission lines, and so on. As used herein, the term "lumped" refers to a unitary component having a specified electrical property and value, such as a resistor, inductor, or capacitor, and is differentiated from a distributed element such as a transmission line. The feed point 112 is coupled to the inverted F section 114 that can include a shunted feed termination that is typically grounded 115. An inverted F antenna conventionally has a distal end that is un-terminated. In the present arrangement, what would conventionally be an un-terminated end is coupled to a monopole section 116. The monopole section 116 can include one or more monopole elements. Monopole elements have an omni-directional radiation pattern, generally, in a circumference around an axis of the monopole element. The monopole section 116 is further coupled to a helical section 118 that includes a helical wound conductor element. In some embodiments the helical section 118 and a portion of the monopole section 116 can be disposed in an external antenna unit, as indicated by box 120, that can be removably connectable to the remaining portion of the antenna structure 111 that is disposed inside, or otherwise more permanently attached to the radio device 100. In some embodiments, multiple different external antenna units can be designed having different number of windings in the helical section 118 which adjust the operating frequency of the antenna structure 111 for operation in different frequency bands.

Figure 2:
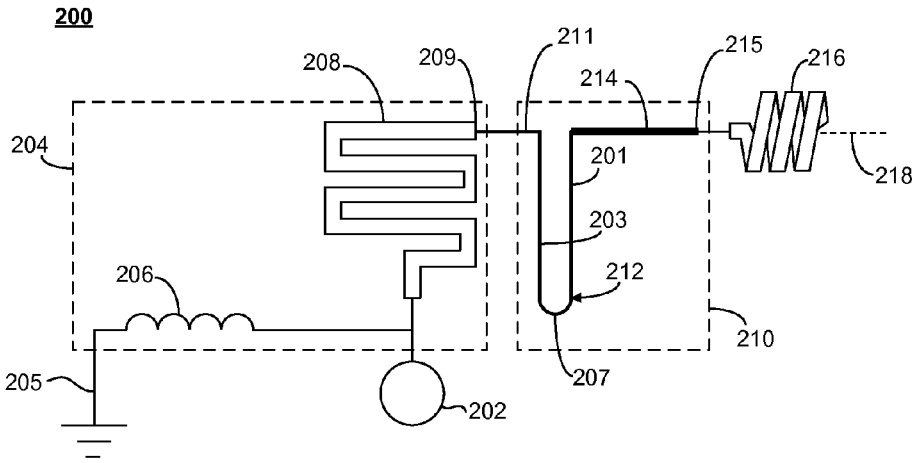
FIG. 2 is a schematic diagram of an antenna structure in accordance with some embodiments.

FIG. 2 is a schematic diagram of an antenna structure 200 in accordance with some embodiments. The antenna structure 200 shown here is a more detailed example of an embodiment of an antenna structure 111 shown generally in FIG. 1. The antenna structure 200 begins at a feed point 202 which couples to a radio circuit (not shown). The feed point 202 is the interface between the antenna structure 200 and the radio circuit, and its physical location within the radio device can affect the performance of the antenna structure 200. The feed point is further coupled to an inverted F structure 204 that includes an inductive feed shunt 206 and a meander portion or element 208. The inductive feed shunt 206 can include distributed inductive elements and/or lumped inductive elements, and is coupled between the feed point 202 and a ground or ground plane 205. The meander element 208 generally follows a path away from the feed point with contiguous conductive sections that can run perpendicular to a line away from the feed point. That is, the path of the meander element 208 meanders back and forth several times as the path of the meander element moves generally away from the feed point 202. The meander element 208 can be a strip line formed on a printed circuit board, where the width of the strip line can be adjusted for desired performance. Furthermore, while it is common to have one layer of a printed circuit board to be used as a ground plane, in some embodiments the section of the circuit board on which the meander element 208 is disposed can be lacking a ground plane so that the meander element 208 is not directly over a ground plane. The meander element 208 has a distal end 209 opposite the feed point 202 that terminates the meander element 208. In a conventional use of an inverted F antenna element 204 the distal end 209 is typically open or un-terminated. In the present application, however, the distal end 209 of the meander element 204 is coupled to a first end 211 of the monopole section 210.

The monopole section 210 can include multiple monopole elements coupled in series, such as a first monopole element 212 that can be a U-shaped monopole element, and a second monopole element 214 that can be a straight line element. In some embodiments the U-shaped monopole element 212 can be arranged such that a plane defined by the U-shaped monopole element 212 is oriented differently than a plane defined by the meander element 208. The U-shaped monopole element 212 and the meander element 208 are both shown here in the same plane due to the limitations of the drawing and are presented both in the plane of the drawing sheet for clarity in showing their inclusion in the antenna structure 200 generally. The U-shaped monopole element 212 can include two generally parallel segments 201, 203 joined by a turn segment 207. The parallel segments 201, 203 can be equal or different lengths, and the turn segment 207 can be rounded, squared, or shaped otherwise. The monopole section 210 has a distal end 215 that is coupled to the helical section 216. The helical section 216 comprises a conductor winding where the conductor winding spirals around an axis 218. The conductor can be a wire or a flat/ribbon shaped conductor. The winding path around the axis 218 can be substantially round, flattened, squared, or shaped otherwise, when viewed along the winding axis 218.

In some embodiments the meander element 208 can be a conductor disposed on a printed circuit board. The monopole section 210 can be coupled to the distal end 209 of the meander element 208 by a spring or cantilevered contact means. Likewise, the second monopole element 214 can be connected to the U-shaped monopole element 212 via a spring or cantilevered contact means.

Figure 3:
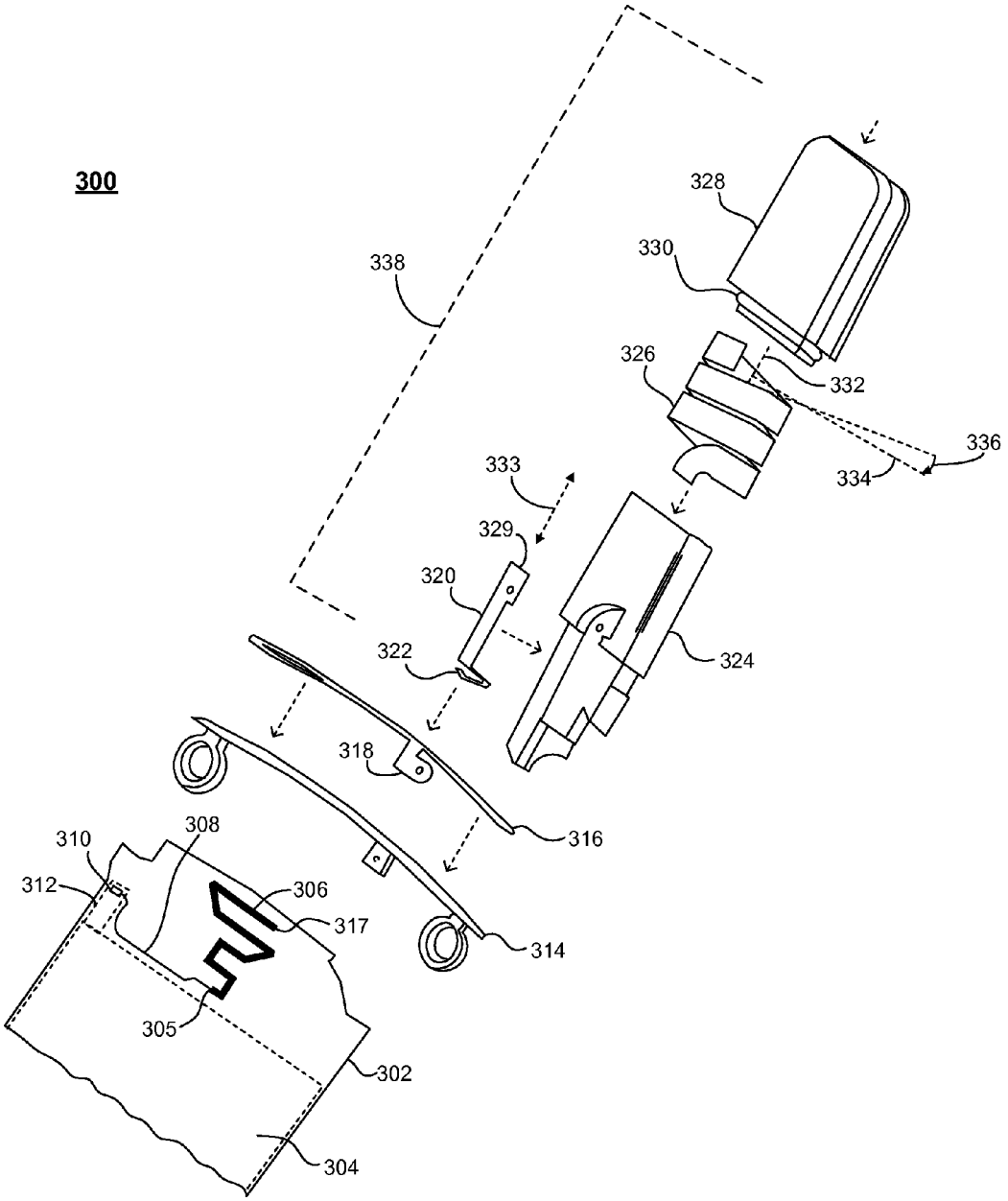
FIG. 3 is a front plan exploded view of a portable radio device having an antenna structure, in accordance with some embodiments.

FIG. 3 is a front plan exploded view of components of a portable radio device having an antenna structure 300, in accordance with some embodiments. Some portions of the radio device, such as housing sections, have been omitted for clarity. The antenna structure 300 shown here, and in FIGS. 4-6, can be an example of a more specific implementation of an antenna structure in accordance with some embodiments shown more generally in FIGS. 1-2. The portable radio device includes a circuit board 302 that can be a multi-layer printed circuit board used to carry and connect various circuit elements, such as integrated and discrete circuit components, connectors, button elements, interconnecting conductive runners, solder pads, through-hole vias, and so on, as is well known. In a multi-layer circuit board it is common for one or more layers to include a ground plane layer 304 that is typically one of the inner layers. The circuit board 302 includes an inverted F section comprised of a meander element 306 that is fed at a feed point 305. An inductive shunt or shunt line 308 connects the feed point to a ground section 312, and can include a series lumped inductive element 310 or other lumped circuit elements (resistors, capacitors). The meander element 306 can be disposed on a portion of the circuit board 302 that lacks or otherwise excludes a ground plane 304 (to avoid capacitive loading/detuning) The feed point 305 can be centrally located within the portable radio device on the circuit board 302, meaning a substantial distance away from the periphery edges of the circuit board. The meander element 306 can have contiguous segments at various angles to each other, including segments at 90 degrees, 45 degrees, and 135 degrees. The meander element 306 meanders away from the feed point towards a periphery of the circuit board 302. In some embodiments the meander element can have a width of substantially one millimeter and a total length of about fifty two millimeters.

An internal carrier element 314, comprised of a non-conductive material, can be used to carry a first monopole element that can be a U-shaped monopole element 316 (turned on its side in this view) that can be substantially planar. The internal carrier element 314 can additionally provide a mechanical function in the portable radio device that is unrelated to the antenna structure 300. The U-shaped monopole element 316 can have a connecting feature 318 that can be a cantilevered contact feature that makes contact with a conductive pad on the circuit board 302 that is electrically coupled to a distal end 317 of the meander element 306. The U-shaped monopole element 316 can be oriented in a plane that is orthogonal to a plane in which the meander portion 306 of the inverted F element is oriented. A second monopole element 320 can be coupled to the U-shaped monopole element 316 via a cantilevered spring contact 322 that makes contact with the U-shaped monopole element 316 at a terminal end of the U-shaped monopole element 316. In some embodiments the second monopole element 320 can be disposed or placed on an external carrier 324, and can be a straight conductor element extending away from the U-shaped monopole element 316 outwards from the portable radio device. Furthermore, the U-shaped monopole element 316 and the second monopole element 320 can have different orientations, while in other embodiments they can have similar orientations. For example, the second monopole element or monopole line 320 can be oriented along an axis 333 that can be perpendicular to a plane of the U-shaped monopole element 316. The external carrier 324 can further contain or carry a helical antenna element 326. The helical antenna element 326 can be coupled to a distal or terminal end 329 of the second monopole element 320. A cover 328 can be used to cover the external carrier 324, helical antenna element 326, and second monopole element 320. The second monopole element 320, external carrier 324, helical antenna element 326, and cover 328 can be disposed together in an external antenna unit 338. The external antenna unit 338 can be removably connectable to the portable radio device, such as by means of an interference or detent feature 330 that interacts with a corresponding feature in the housing (not shown) of the portable radio device to retain the external antenna unit 338, but which allow a person to remove the external antenna unit by pulling on it with sufficient force. The external antenna unit 338 can alternatively be removably secured using a screw means or any other suitable known technique that allows a removable attachment and electrical connection.

The helical element 326 comprises a wound conductor element that is wound around an axis 332. The axis 332 can be parallel to an axis 333 of the second monopole element or monopole line 320. The conductor of the helical element 326 can be a flat conductor similar to a ribbon, and can be implemented by a flexible circuit board ("flex") element that is wound in a helix. The windings of the helical antenna element 326 have a pitch that is defined as the angle 336 at which they are wound relative to a line 334 that is perpendicular to the axis 332. In some embodiments the pitch can be on the order of six degrees. The number of windings can vary, based on the desired frequency response of the antenna structure. In some embodiments several different versions of the external antenna unit 338 can be designed corresponding to different operating frequency bands, with each version utilizing a helical element 326 having a different number of winding turns relative to the other versions.

Figure 4:
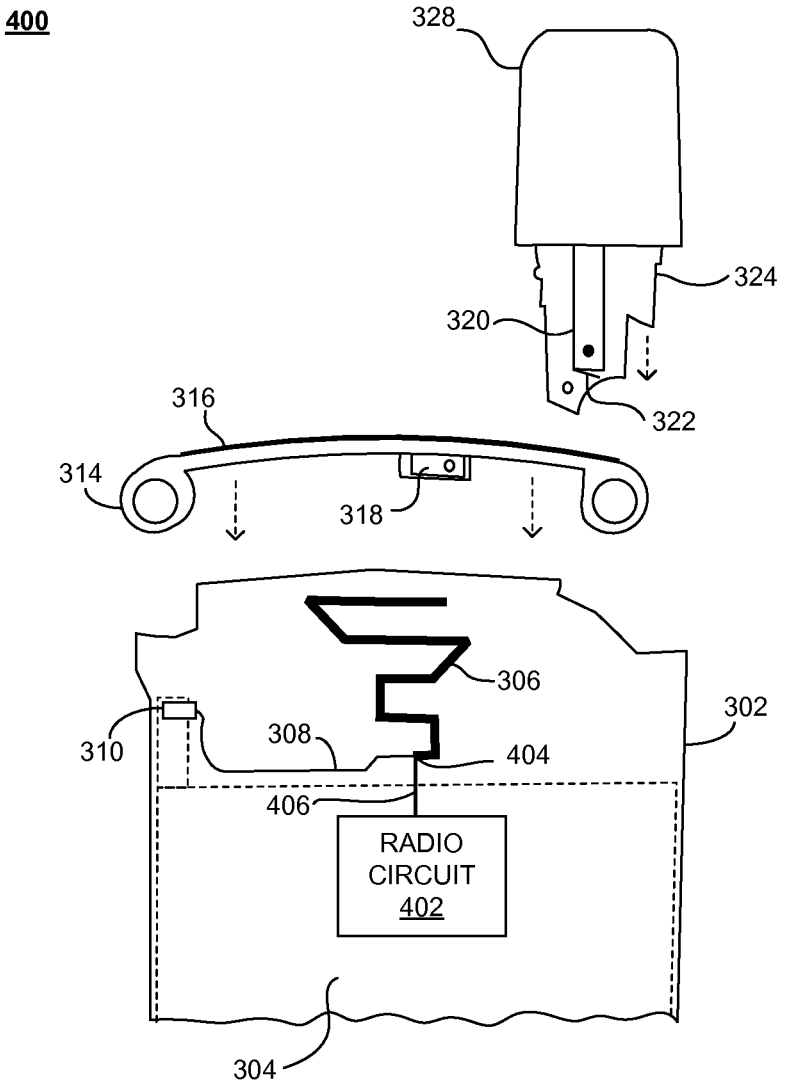
FIG. 4 is a front plan exploded view of a portable radio device having an antenna structure that is partially assembled, in accordance with some embodiments.

FIG. 4 is a front plan exploded view of a portable radio device 400 having an antenna structure that is partially assembled, in accordance with some embodiments. The portable radio device 400 shown here is substantially similar to that of FIG. 3, with some sub-assembly of various components. In particular the U-shaped monopole element 316 is shown on the internal carrier element 314, and the external carrier 324 is shown with the cover 328 assembled together, hiding the helical element 326 therein. A radio circuit 402 is further shown, and can be a transmitter circuit, receiver circuit, or transceiver circuit. The radio circuit 402 is coupled to a feed point 404 of the antenna structure, such as by a transmission line element 406, specifically at the start of the meander element 306. Circuitry for matching the radio circuit 402 to the antenna structure can be disposed between the radio circuit 402 and feed point 404.

Figure 5:
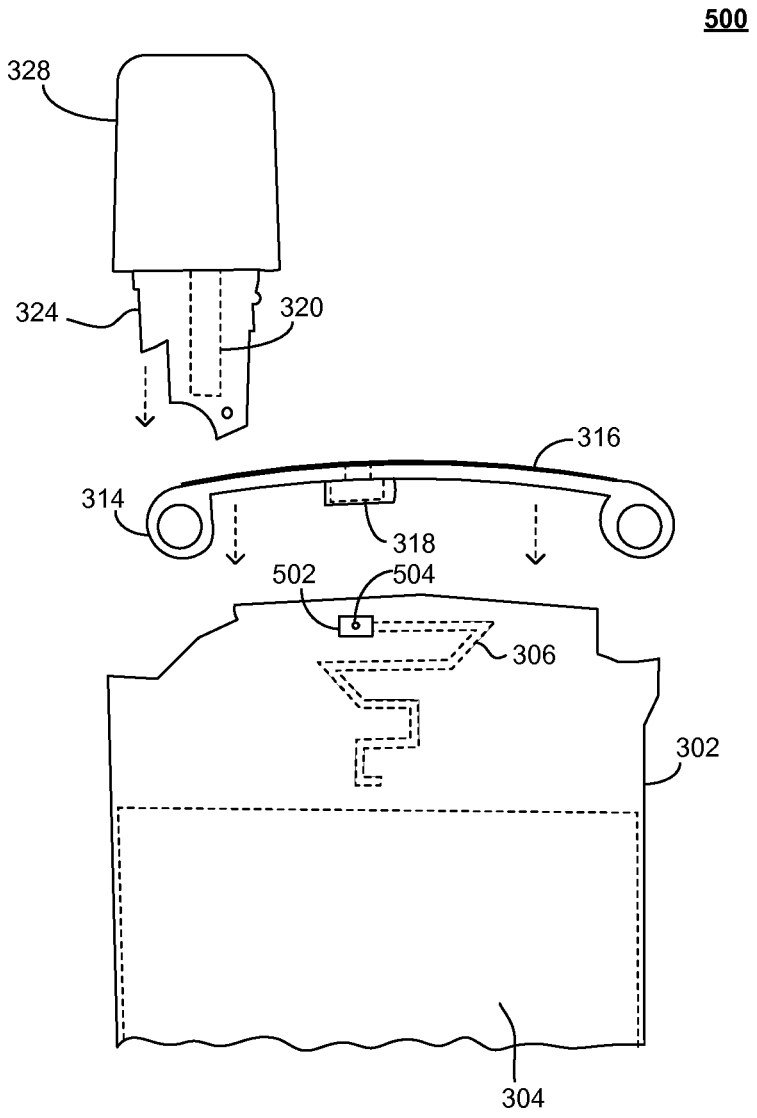
FIG. 5 is a reverse plan exploded view of a portable radio device having an antenna structure that is partially assembled, in accordance with some embodiments.

FIG. 5 a reverse plan exploded view of a portable radio device 500 having an antenna structure that is partially assembled, in accordance with some embodiments. The drawing presented here can be the reverse view of that shown in FIG. 4, and shows how the U-shaped monopole element 316 is electrically coupled to the distal end of the meander element 306. At the distal end of the meander element 306, a conductive pad 502 is exposed, and can be connected to the distal end of the meander element 306 by a plated via through hole 504 that goes through the circuit board 302 to the distal end of the meander element 306. The connecting feature 318 makes contact with the pad 502 when internal carrier element 314 is assembled into the portable radio device 500 to connect the U-shaped monopole element 316 to the meander element 306.

Figure 6:
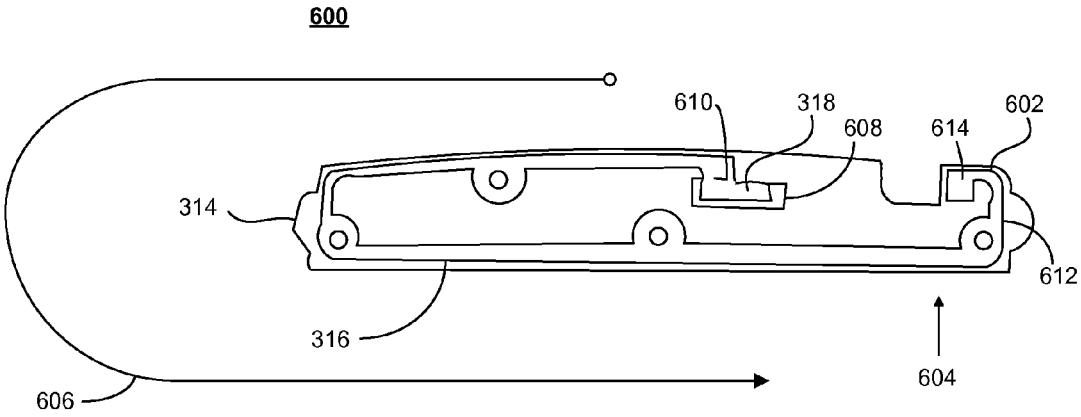
FIG. 6 is a top plan view of a U-shaped monopole element disposed on a carrier element, in accordance with some embodiments.

FIG. 6 is a top plan view of a U-shaped monopole element 316 disposed on a carrier element 314, in accordance with some embodiments. In FIGS. 3-5 the carrier element 314 and U-shaped monopole element 316 were viewed from their side, such as in the direction of arrow 604. The carrier element 314 is made of an electrically non-conductive material and the U-shaped monopole element 316 is disposed on a top surface of the carrier element 314 in the present example. Of course, many variations of arranging a U-shaped monopole element 316 will occur to those skilled in the art, and the present example is not meant to be limiting and shows an example of an arrangement that can be used in one or more embodiments. The U-shaped monopole element 316 can be provided on the carrier element 314 by, for example, selectively plating a corresponding U-shaped region of the carrier element 314 to form a plated conductor. The connecting feature 318 in the present example is located under the carrier element 314 (see FIGS. 3-5) and connects to a first end 610 of the U-shaped monopole element 316 through a hole 608 in the carrier element 314. The U-shaped monopole element 316 continues around the top of the carrier element 314 generally in a U shape as indicated by arrow 606, to a terminal end 602.

The U-shaped monopole element 316 does not necessarily have to be symmetric, and can have one side longer that the other, and even include a turn 612 before the terminal end 602. The terminal end 602 can include an exposed conductive region or pad 614 that is used to electrically connect to the second monopole element 320 as shown in FIGS. 3-5 in embodiments where the monopole section is divided into multiple monopole elements. The cantilevered spring contact 322 of the second monopole element 320 can be pressed into contact with the conductive pad 614, forming an electrical connection.

Figure 7:
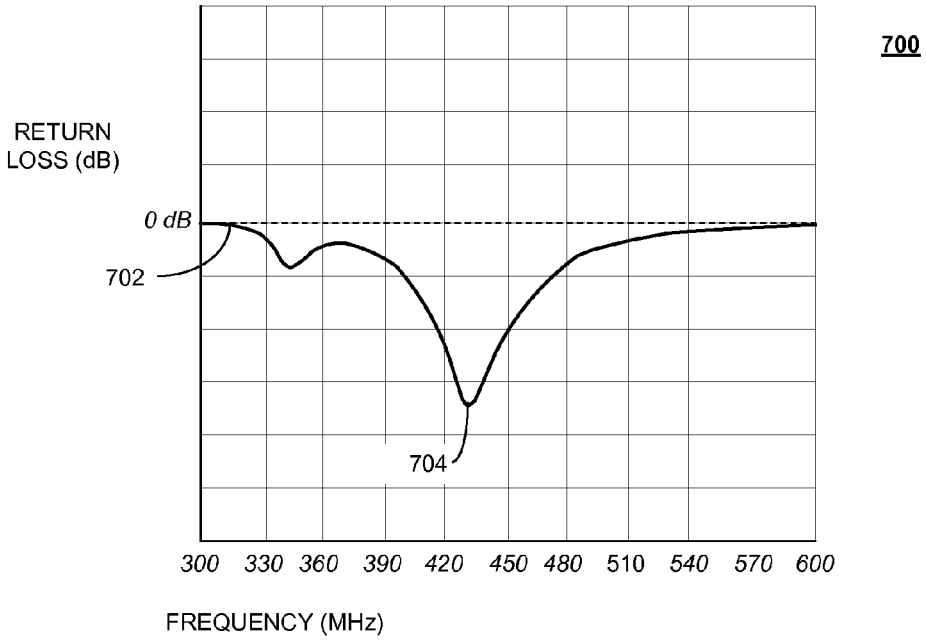
FIG. 7 is a graph plot of return loss over frequency of an antenna structure in accordance with some embodiments.

FIG. 7 is an exemplary graph plot 702 of return loss over frequency of an antenna structure in accordance with some embodiments. The graph plot is on a graph chart 700 where return loss in decibels is shown on the vertical axis, and the horizontal axis is frequency in megahertz, beginning at 300 MHz and ending at 600 MHz. The antenna structure used to produce the graph plot 702 was substantially similar to that shown in FIGS. 3-6. The return loss indicates the reflected power, and the lower the return loss the more power is radiated from the antenna structure. Thus, minimum 704 represents the frequency at which the lowest amount of power is reflected and the most power is therefore radiated. The band at which the minimum 704 occurs in a frequency band commonly used for public safety radio communication.

Figure 8:
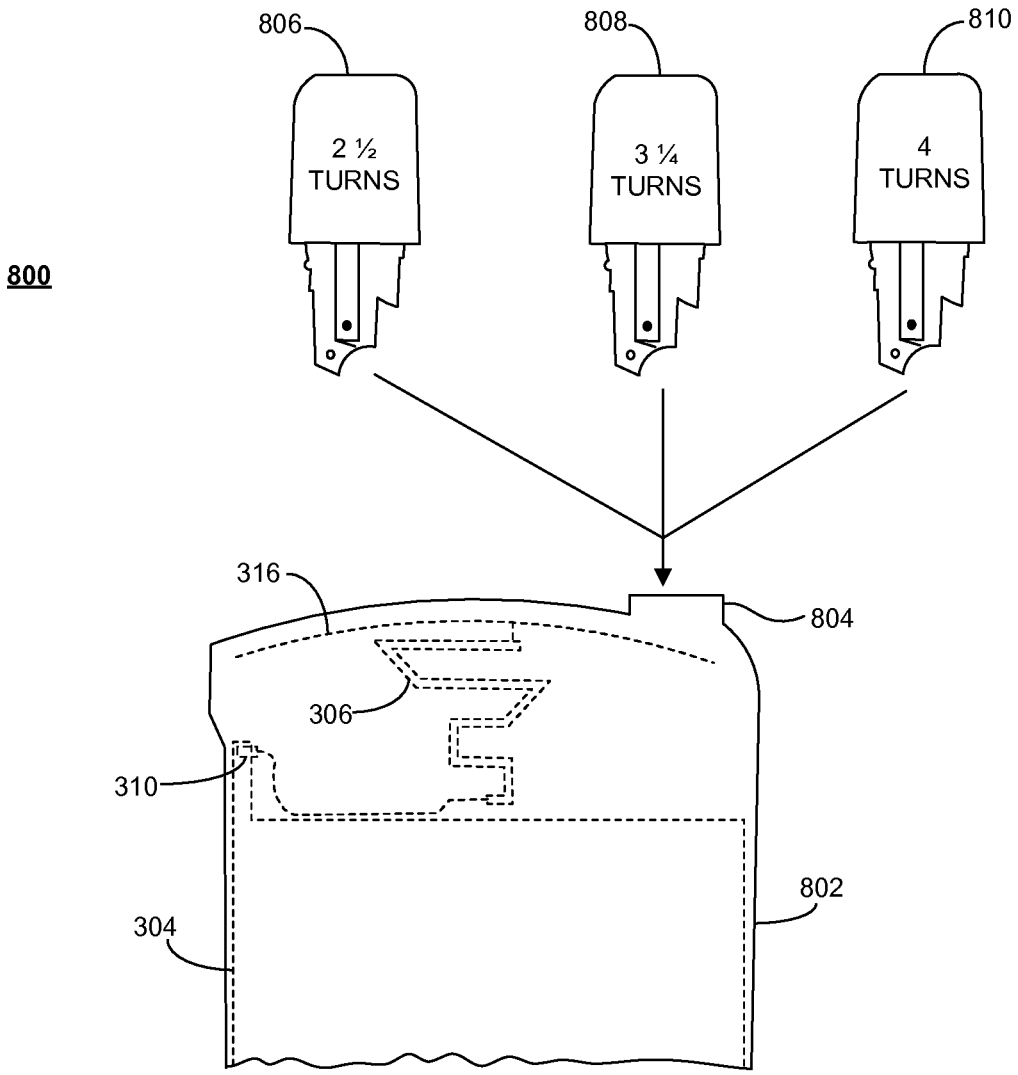
FIG. 8 shows a portable radio device useable with different external antenna elements forming part of an antenna structure in accordance with some embodiments.

FIG. 8 shows a portable radio device 800 useable with different external antenna elements 806, 808, 810 forming part of an antenna structure in accordance with some embodiments. The external antenna units 806, 808, 810 are interchangeable and are each used for operating the portable radio device at a different frequency band. The housing 802 of the portable radio device can have formed thereon a boss 804 or other receiving feature into which an external antenna element 806, 808, 810 can be inserted and removably retained. Upon insertion, the antenna element or elements contained in the external antenna unit are electrically coupled to other antenna elements inside the portable radio device, such as a meander element 306 coupled in series with a U-shaped monopole element 316. Each of the external antenna units 806, 808, 810 contain a helical element with a different number of windings, and hence each results in the overall antenna structure having a different operating frequency range when connected to the portable radio device 800. Thus, a user of the portable radio device can switch frequency bands by changing the external antenna element. By incorporating most of the antenna structure (inverted F section and at least part of the monopole section) inside the portable radio device, and putting the compact helical element in an external antenna unit, the size of the external antenna unit can be minimized compared to the conventional external antenna arrangement of existing systems which put the entire antenna structure in the external antenna unit. Furthermore, it will be appreciated by those skilled in the art that for applications where the portable radio device (or other radio device) does not need to operate over different frequency bands, the helical element can also be an internal element disposed permanently inside the radio device.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An antenna structure for a portable radio transceiver device, comprising:

an inverted F section having a feed point, an inductive feed shunt coupled between the feed point and a ground, and a meander portion having a distal end opposite the feed point;

a monopole section having a first end and a terminal end, the first end coupled to the distal end of the inverted F section;

a helical section coupled to the terminal end of the monopole section; and wherein the monopole section comprises a first monopole element and a second monopole element coupled in series, the first monopole element coupled to the distal end of the inverted F section, the second monopole element coupled to the helical section, the first and second monopole elements having different orientations, the first monopole element is a substantially U-shaped element having a planar configuration oriented in a plane that is orthogonal to a plane of orientation of the meander portion of the inverted F section, wherein the meander portion is disposed on a circuit board, and the first monopole element is disposed on a carrier element separate from the circuit board, and wherein the first monopole section is coupled to the distal end of the meander portion via a spring contact.

2. An antenna structure for a portable radio transceiver device, comprising:

an inverted F section having a feed point, an inductive feed shunt coupled between the feed point and a ground, and a meander portion having a distal end opposite the feed point;

a monopole section having a first end and a terminal end, the first end coupled to the distal end of the inverted F section;

a helical section coupled to the terminal end of the monopole section; and wherein the monopole section comprises a first monopole element and a second monopole element coupled in series, the first monopole element coupled to the distal end of the inverted F section, the second monopole element coupled to the helical section, the first and second monopole elements having different orientations, and wherein the second monopole element is a straight conductor element extending away from the first monopole element outwards from the portable radio transceiver device.

3. An antenna structure for a portable radio transceiver device, comprising:

an inverted F section having a feed point, an inductive feed shunt coupled between the feed point and a ground, and a meander portion having a distal end opposite the feed point;

a monopole section having a first end and a terminal end, the first end coupled to the distal end of the inverted F section;

a helical section coupled to the terminal end of the monopole section, wherein the helical portion has a number of windings corresponding to one of a plurality of operating frequency bands; and wherein a portion of the monopole section and the helical section are disposed in an external antenna unit that is removably connectable to the portable radio transceiver device.

4. An antenna structure, comprising:

a feed point;

a meander element coupled at a first end of the meander element to the feed point and disposed in a plane;

an inductive shunt coupled between the feed point and a ground;

a monopole element having a substantial U-shape in a plane perpendicular to the plane of the meander element, the monopole element having a first end coupled to a second end of the meander element;

a monopole line having a first end coupled to a second end of the monopole element and having an axis that is substantially perpendicular to the plane of the monopole element and extending away from the monopole element and the meander element; and a helical element having a first end coupled to a second end of the monopole line and having an axis substantially parallel to the axis of the monopole line, wherein the helical element forms a helix around the axis of the helical element.

5. The antenna structure of claim 4, wherein the monopole line and the helical element are disposed together in an external antenna unit that is removably connectable to a portable radio transceiver device in which the feed point, meander element, inductive shunt, and monopole element are disposed.

6. The antenna structure of claim 4, wherein the antenna structure is an antenna structure for a portable radio transceiver device, the feed point being centrally located within the portable radio transceiver device.

7. The antenna structure of claim 4, wherein the meander element is disposed on a circuit board having a ground plane, wherein the ground plane does not extend under a region of the circuit board on which the meander element is disposed.

8. A portable radio device, comprising:

a radio circuit;

a feed point coupled to the radio circuit;

a meander element coupled at a first end of the meander element to the feed point and disposed in a plane;

an inductive shunt coupled between the feed point and a ground;

a monopole element having a substantial U-shape in a plane perpendicular to the plane of the meander element, the monopole element having a first end coupled to a distal end of the meander element;

a monopole line having a first end coupled to a second end of the monopole element and having an axis that is substantially perpendicular to the plane of the monopole element and extending away from the monopole element and the meander element; and a helical element having a first end coupled to a second end of the monopole line and having an axis substantially along the axis of the monopole line, wherein the helical element forms a helix around the axis of the helical element.

9. The portable radio device of claim 8, wherein the feed point, meander element, inductive shunt, and monopole element are disposed internal to the portable radio device, and the monopole line and helical element are disposed together in an external antenna unit that is removably connectable to a portable radio device.

10. The portable radio device of claim 9, wherein the external antenna unit is one type of a plurality of different types of external antenna units for use with the portable radio apparatus, wherein each of the different types of external antenna units have a different number of winding turns in the helical element.

11. The portable radio device of claim 8, wherein the monopole element comprises a plated conductor disposed on a non-conductive internal carrier element.

12. The portable radio device of claim 11, wherein the monopole element is coupled to the distal end of the meander element by a cantilevered contact.

* * * * *